US011276267B2

(12) United States Patent
Denny et al.

(10) Patent No.: US 11,276,267 B2
(45) Date of Patent: Mar. 15, 2022

(54) MEDIA ROTATION MECHANISM

(71) Applicant: NCR Corporation, Atlanta, GA (US)

(72) Inventors: Ian McFarlane Denny, Perth (GB); Andrew Robert Grant, Dunblane (GB); Peter Roy Vettraino, Fife (GB); Ian James Walker, Ceres (GB)

(73) Assignee: NCR Corporation, Atlanta, GA (US)

( * ) Notice: Subject to any disclaimer, the term of this patent is extended or adjusted under 35 U.S.C. 154(b) by 245 days.

(21) Appl. No.: 16/556,401

(22) Filed: Aug. 30, 2019

(65) Prior Publication Data

US 2021/0065495 A1 Mar. 4, 2021

(51) Int. Cl.

| | |
|---|---|
| ***G07F 19/00*** | (2006.01) |
| ***G07F 11/54*** | (2006.01) |
| ***B65H 9/00*** | (2006.01) |

(52) U.S. Cl.

CPC ..... *G07F 11/54* (2013.01); *B65H 9/002* (2013.01); *G07F 19/20* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,884,514 | A * | 12/1989 | Shockey | G07F 19/20 109/24.1 |
| 5,020,789 | A * | 6/1991 | Droge | G07F 19/20 271/184 |
| 7,240,829 | B2 * | 7/2007 | Graef | G07F 1/041 235/379 |
| 9,098,089 | B2 * | 8/2015 | Kallin | G05D 3/10 |
| 10,068,436 | B2 * | 9/2018 | Swaine | G07F 11/045 |
| 2014/0054368 | A1 | 2/2014 | Li et al. | |

FOREIGN PATENT DOCUMENTS

| | | |
|---|---|---|
| EP | 2728558 A1 | 5/2014 |
| WO | 2013061470 | 5/2013 |

OTHER PUBLICATIONS

EP Search Report.

* cited by examiner

*Primary Examiner* — Christle I Marshall
(74) *Attorney, Agent, or Firm* — Schwegman, Lundberg & Woessner

(57) ABSTRACT

Disclosed is a media rotation mechanism. The media rotation mechanism may include a housing, a media receiver, and a rotation motor. The housing may define a first opening and a second opening. The media receiver may define a media receiver opening. The rotation motor may be configured to rotate the media receiver between a first position and a second position. The first position may correspond to the media receiver opening facing the first opening. The second position may correspond to the media receiver opening facing the second opening.

18 Claims, 7 Drawing Sheets

MEDIA ROTATION MECHANISM

BACKGROUND

Legacy vacuum tube drive-up units currently in-service function by the driver communicating with an on-site bank teller via a microphone and loud speaker. Any media which passes between the bank staff and the customer (or vice versa) must be loaded into a round cassette which is then transferred using a system of vacuum powered pipes. For these units to function they must be manned by bank staff located in on-site mini-banks. This is an expensive operation as all transactions must be individually processed one after the other resulting in high transaction times and poor customer satisfaction.

SUMMARY

Disclosed is a media rotation mechanism. The media rotation mechanism may include a housing, a media receiver, and a rotation motor. The housing may define a first opening and a second opening. The media receiver may define a media receiver opening. The rotation motor may be configured to rotate the media receiver between a first position and a second position. The first position may correspond to the media receiver opening facing the first opening. The second position may correspond to the media receiver opening facing the second opening.

BRIEF DESCRIPTION OF THE FIGURES

The above-mentioned and other features and advantages of this invention, and the manner of attaining them, will become more apparent and the invention itself will be better understood by reference to the following description of embodiments taken in conjunction with the accompanying drawings, wherein.

Corresponding reference characters indicate corresponding parts throughout the several views. The examples set out herein illustrate possible embodiments, and such examples are not to be construed as limiting the scope of this disclosure in any manner.

DETAILED DESCRIPTION

To replace legacy vacuum tube drive-up terminals, drive-up automated teller machines (ATM) units may use the media rotation mechanisms disclosed herein. The island on which legacy vacuum tube drive-up terminals are installed have a depth ranging from 18 inches to 24 inches. Without the media rotation mechanisms disclosed herein, drive-up ATM are not capable of being mounted within the 18-24 inch depth of islands where legacy vacuum tube drive-terminals are installed. The media rotation mechanisms disclosed herein, allows an ATM to be constructed which can readily be mounted on an island of having a depth of 18 inches to 24 inches.

The media rotation mechanisms disclosed herein allow for media presented from a recycler that may be stored in a safe module, to then be turned through an angle ranging from about 20° to about 180°, such as 90°, and then to be presented to a shutter for retrieval by a user. The reverse may also occur where a user may present media to the ATM via the shutter and the media rotation mechanisms may rotate the media through an angle for presentation to a recycler. By using the rotation mechanisms disclosed herein, the safe and main media module may be rotated through an angle such as 90° so as to significantly reduce the depth of the ATMs.

Figure 1A:
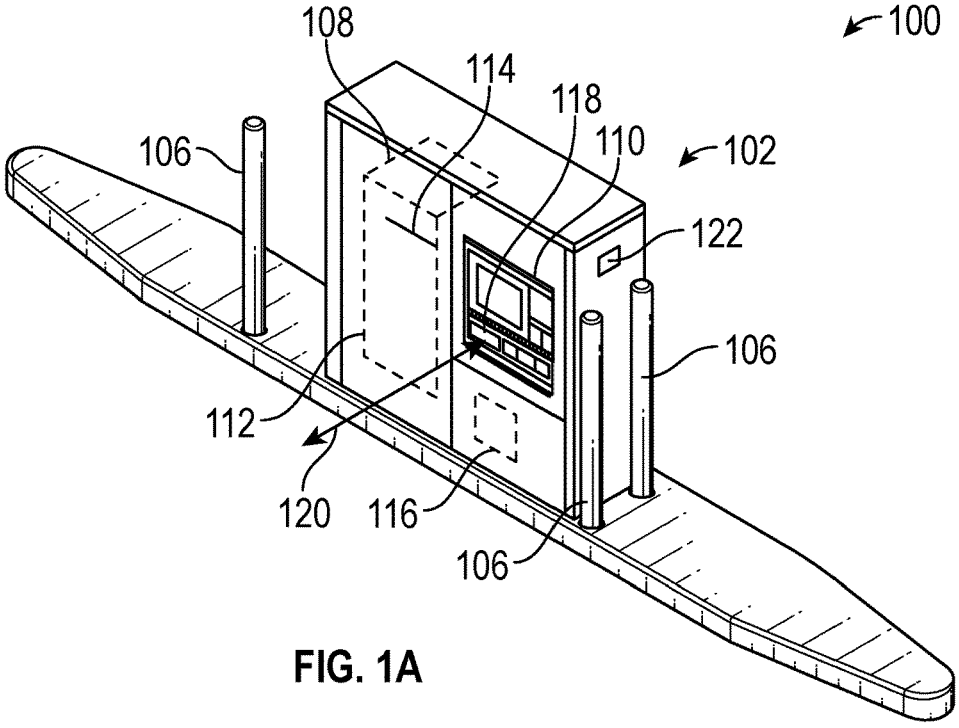
FIG. 1A shows an example operating environment consistent with this disclosure.

Turning now to the figures, FIG. 1A shows an example operating environment 100 consistent with this disclosure. As shown in FIG. 1A, environment 100 may include a media terminal 102, such as an ATM, that is mounted on a curb 104 with protective barriers 106. Media terminal 102 may include a safe 108 and a media handler 110. As disclosed herein, media, such as bank notes, cheques, etc., may pass to or from a recycler 112 to media handler 110 as indicated by arrow 114. A media rotation mechanism 116, which may be a component of media handler 110, may rotate the media through an angle, such as 90°. Upon rotating the media, media rotation mechanism 116 may present the media to the user through a shutter 118 as indicated by arrow 120. Media terminal 102 may also include a controller 122 that may control operations of media terminal 102 as well as media rotation mechanism 116.

Figure 1B:
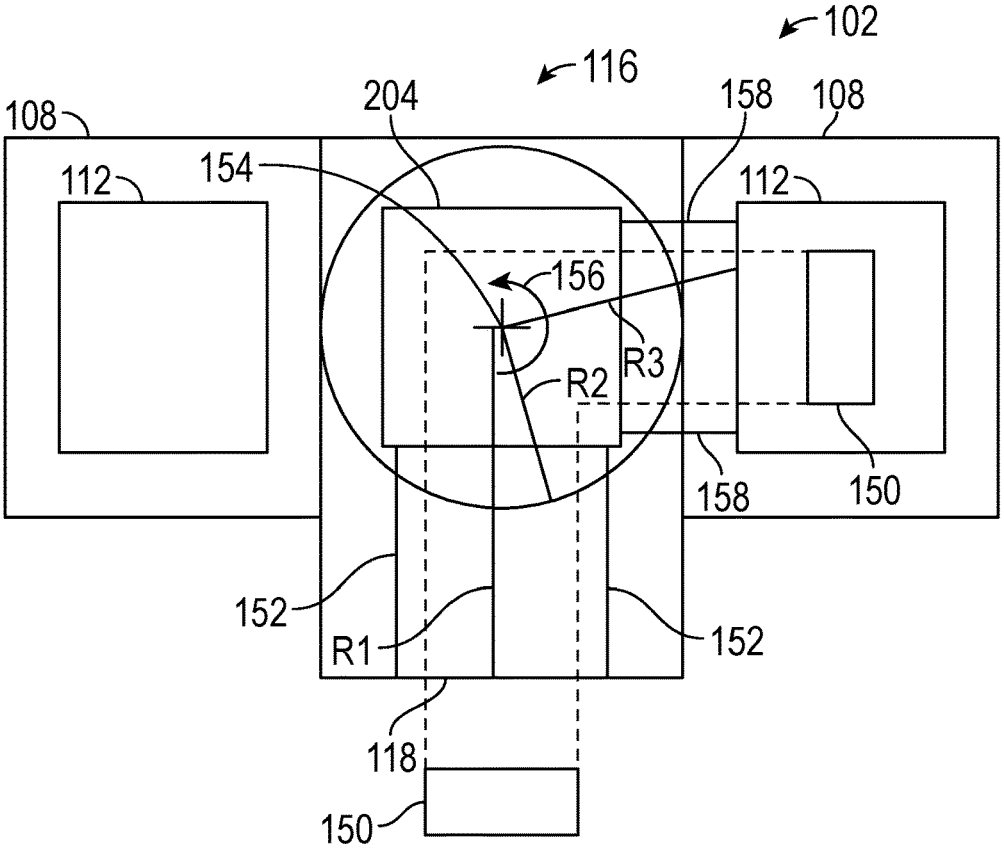
FIG. 1B shows an example schematic for a media path through the media rotation mechanism consistent with this disclosure.

FIG. 1B shows an example schematic for a media path through media rotation mechanism 116 consistent with this disclosure. As shown in FIG. 1B, a media object 150 may be presented by a customer to shutter 118. When media object 150 is presented to shutter 118 a media receiver 204 may translate towards shutter 118 as indicated by arrows 152. Upon receiving media object 150, media receiver 204 may travel towards a pivot point 154. Upon reaching pivot point 154, media receiver 204 may rotate 90° as indicated by arrow 156. Media receiver 204 rotates to change the direction of the path media object 150 travels. After rotating, media receiver 204 may translate as indicated by arrows 158 to present media object 150 to recycler 112. With media receiver 204 located proximate recycler 112, media object 150 may be transferred to recycler 112.

As shown in FIG. 1B, media receiver 204 may translate. The translation of media receiver 204 may allow a radius of rotation for media receiver 204 to be increased and/or decreased. For example, as shown in FIG. 1B, when media receiver 204 is translated towards shutter 118, a radius of rotation as measured from pivot point 154 may be $R_1$. Upon retractions of media receiver 204 to pivot point 154 the radius of rotation may be $R_2$. When media receiver 204 extends towards recycler 112 the radius of rotation may be $R_3$. By changing the radius of rotation, the footprint of media terminal 102 may be minimized so as to fit on curb 104.

Figure 2:
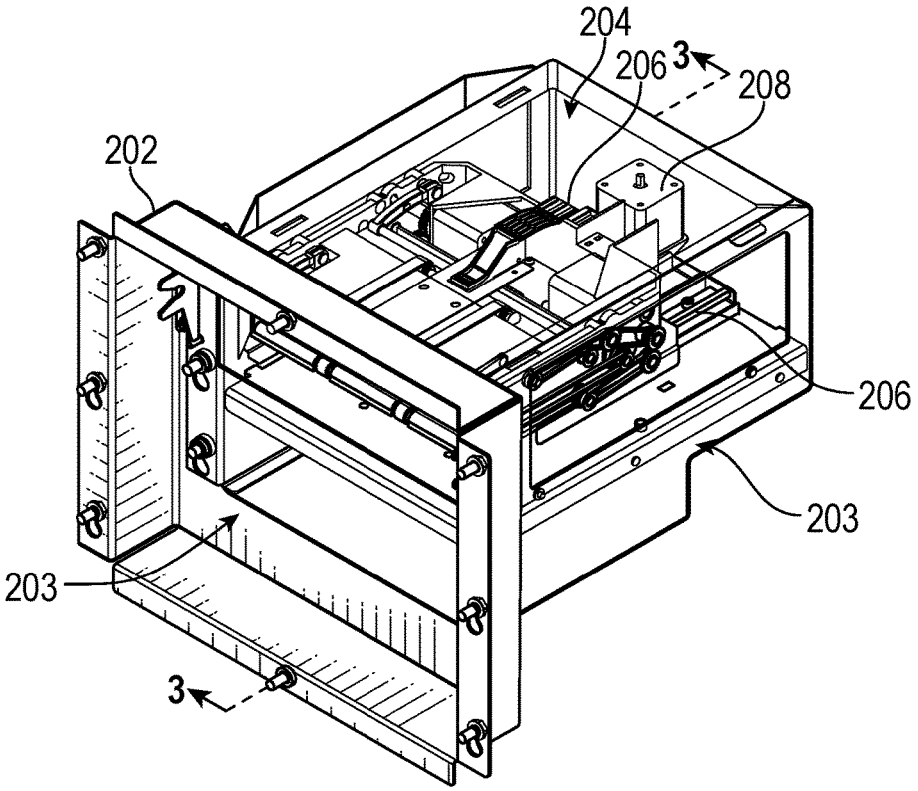
FIG. 2 shows an example media rotation mechanism consistent with this disclosure.
Figure 3:
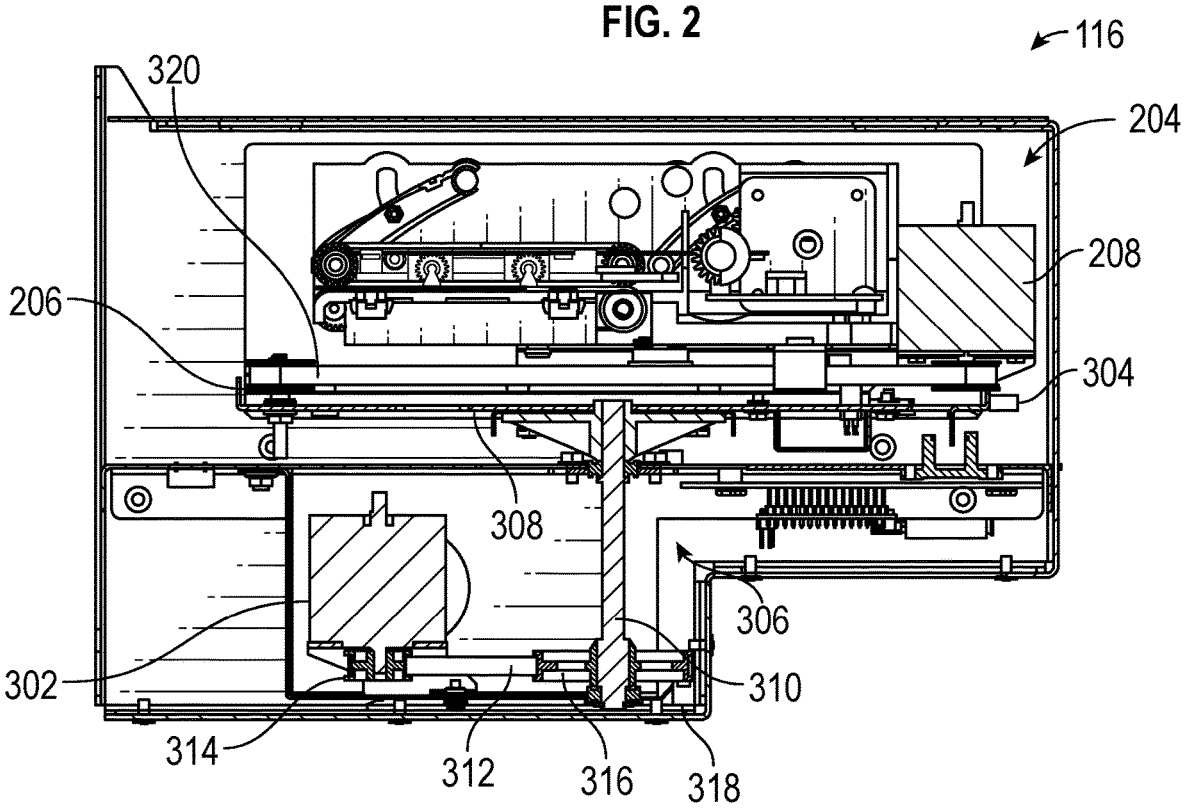
FIG. 3 shows a cross-section of a media rotation mechanism consistent with this disclosure.

FIG. 2 shows an example of media rotation mechanism 116 and FIG. 3 shows a cross-section of media rotation mechanism 116. As shown in FIGS. 2 and 3, media rotation mechanism 116 may include a housing 202, a media receiver 204, tracks 206, a translation motor 208, a rotation motor 302, a limit switch 304, and a turntable 306. Turntable 306 may include a plate 308 and an axle 310. While FIG. 3 shows a turntable 306 coupled to media receiver 204 and rotation motor 302, turntable 306 may be omitted and a spindle of rotation motor 302 may be directly coupled to media receiver 204 to rotate media receiver 204.

Housing 202 may define one or more openings 203. Openings 203 may allow for media to pass into and out of housing 202. Housing 202 may allow media rotation mechanism 116 to be modular. As a result, media rotation mechanism 116 can be easily replaced during maintenance or other service operations if needed.

Axle 310 may be mechanically coupled to rotation motor 302 via a belt 312. Rotation motor 302 may include a pulley 314 and axle 310 may include a pulley 316. Pulleys 314 and 316 may be used to increase torque applied to axle 310 and slow down rotation of axle 310 as compared to the spindle speed of rotation motor 302. While FIG. 3 shows a belt coupling axle 310 to rotation motor 302, other torque transferring elements may be used. For example, one or more gears, chains, etc. may be used to couple axle 310 to rotation motor 302.

Translation motor 208 may be mechanically coupled to media receiver 204 via tracks 206. For example, tracks 206 may be coupled to media receiver and a belt 320 may couple tracks to translation motor 208. During operation, a limit switch 304 may be used to limit translation of media receiver 204. A limit switch 318 may be used to limit rotation of media receiver 204. Non-limiting examples of limit switches 304 and 318 include optical and mechanical switches, such as a lever, a roller plunger, a whisker type switch, and a reed switch. While a single limit switch has been shown to limit rotational and translational motion of media receiver 204, any number of limits switches may be used to limit motion of media receiver 204 in the rotational and/or translational directions.

Non-limiting examples of translation motor 208 and rotation motor 302 include stepper motors, brushed or brushless motors, servo motors, linear motors, etc. As indicated herein, gears, pulleys, etc. may be used to increase the force applied to tracks 206 and/or torque applied to turntable 306.

As disclosed herein, translation motor 208 and rotation motor 302 may be controlled by controller 122. For example, as disclosed herein, controller 122 may transmit a rotation signal to rotation motor 302. The rotation signal may cause rotation motor 302 to actuate and rotate in a first or second direction. Controller 122 may transmit a translation signal to translation motor 208 and the translation signal may cause translation motor 302 to actuate and translate tracks 206 in a first or second direction. As disclosed herein, controller 122 may also receive interrupt signals from limit switches 304 and/or 318. Upon receiving the interrupt signals, controller 122 may cease transmitting the rotation and/or translation signals. For example, limit switches 304 and/or 318 may be normally open switches and upon media receiver 204 reaching a predetermined position, media receiver 204 may depress limit switches 304 and/or 318 and close a circuit. The closed circuit may allow the interrupt signals to travel to controller 122.

Figure 4:
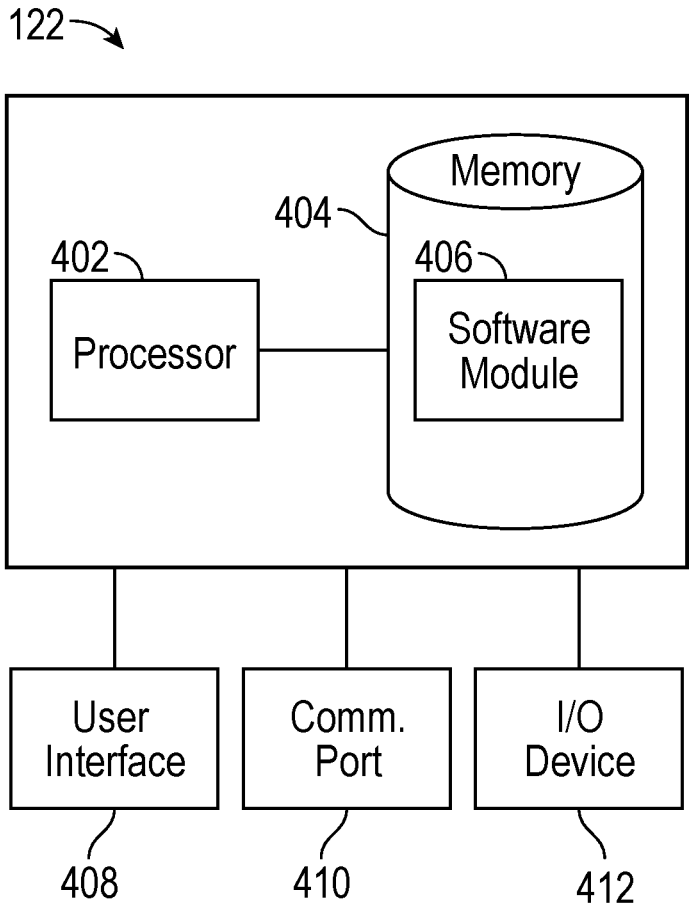
FIG. 4 shows an example schematic of a controller consistent with this disclosure.

FIG. 4 shows an example schematic of a controller 122. Controller 122 may include a processor 402 and a memory 404. Memory 404 may include a software module 406. While executing on processor 402, software module 404 may perform processes for rotating media receiver 204, including, for example, one or more stages included in a method described below with respect to FIGS. 5A-5G and FIG. 6.

Controller 122 may include a user interface 408. User interface 408 may allow a user to deposit media and/or withdraw media from media terminal 102. User interface 408 may also allow a technician or manufacture to program media terminal 102 and configured media rotation mechanism 116. User interface 408 may include a keypad, a display (touchscreen or otherwise), etc. In addition, user interface 408 may include audio equipment such as speakers, a microphone, a headphone jack, etc. that may be used to allow customers, technicians, etc. to interface with media rotation mechanism 116.

Controller 122 may also include a communications port 410. Communications port 410 may allow media terminal 102 to communicate with various information sources, such as, but not limited to, external banking systems, computers operated by tellers, customers, technicians, etc. As disclosed herein, communications port 410 may be wired or wireless. Use of wired or wireless connections may allow media terminal to replace legacy vacuum tube drive-up terminals without a need for bulky plumbing required by legacy vacuum tube drive-up terminals. Non-limiting examples of communications port 410 include, Ethernet cards (wireless or wired), Bluetooth® transmitters and receivers, near-field communications modules, serial port interfaces, etc.

Controller 122 may also include an input/output (I/O) device 412. I/O device 412 may allow controller 122 to receive and output information. Non-limiting examples of I/O device 412 include, a camera (still or video), a printer, a scanner, biometric readers, limit switches, etc. For example, I/O device 412 may include limit switches 304 and/or 318.

Figure 5A:
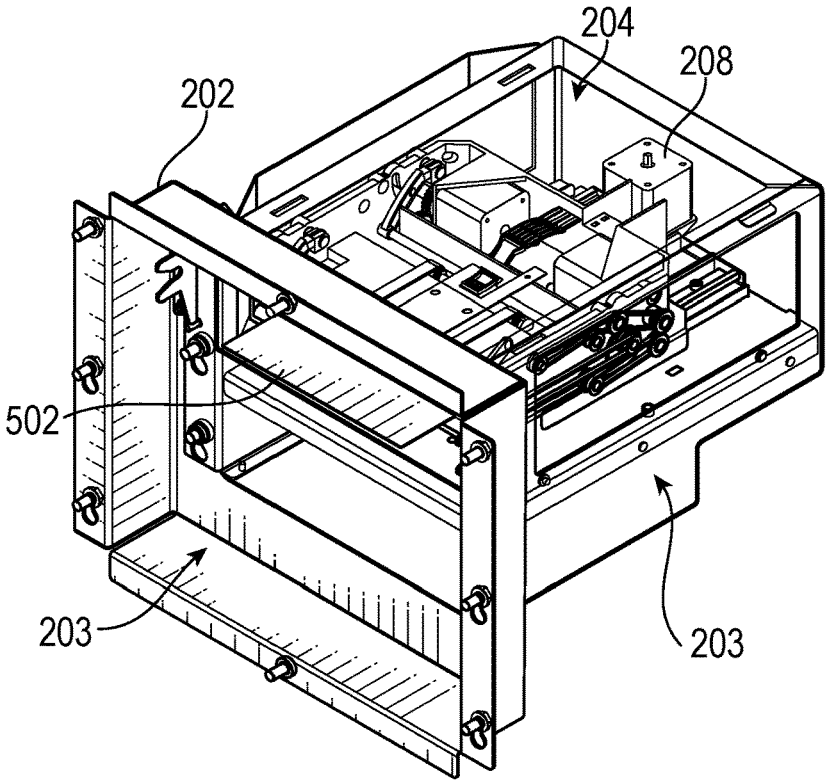
FIGS. 5A-5G show an example method consistent with this disclosure.

FIGS. 5A-5G show stages for transferring media from recycler 112 to media handler 110 and/or media handler 110 to recycler 112. FIG. 6 shows an example method 600 consistent with this disclosure. As shown in FIG. 5A, a media object 502 can be received by media receiver 204 through opening 203. Opening 203 may be located adjacent recycler 112. For example, recycler 112 may define a recycler opening that allows media object 502 to travel into and out of safe 108. Opening 203 may also be located adjacent to shutter 118, which may be located at an angle, such as perpendicular to, recycler opening. While a single media object 502 is shown, a plurality of media objects may be received by media receiver 204. For example, media receiver 204 may receive a plurality of bank notes from recycler 112 to dispense to a customer or from the customer to be deposited into recycler 112.

Figure 5B:
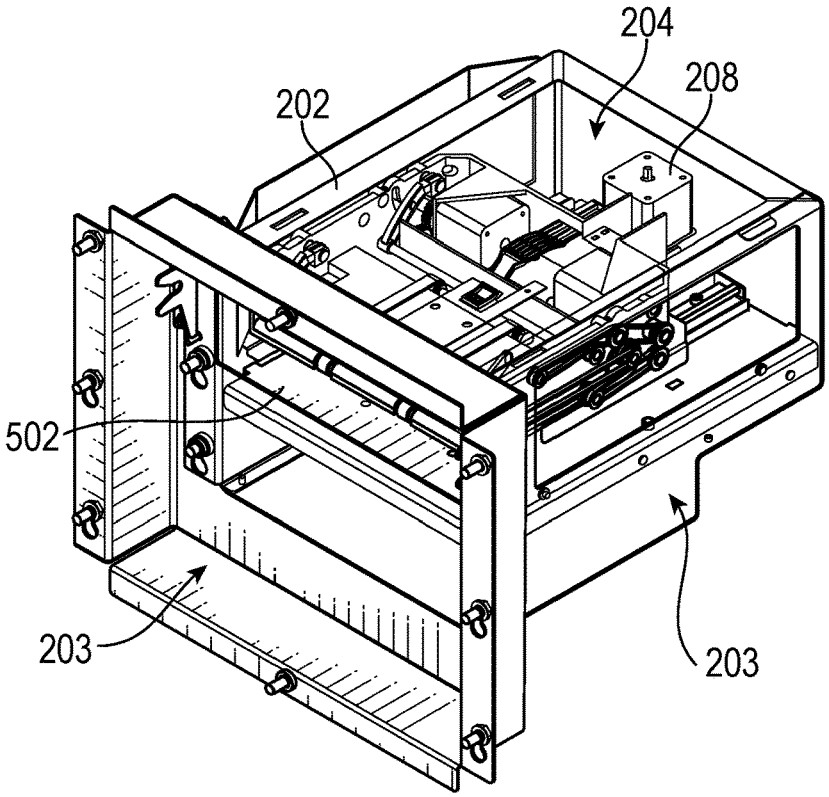
Figure 6:
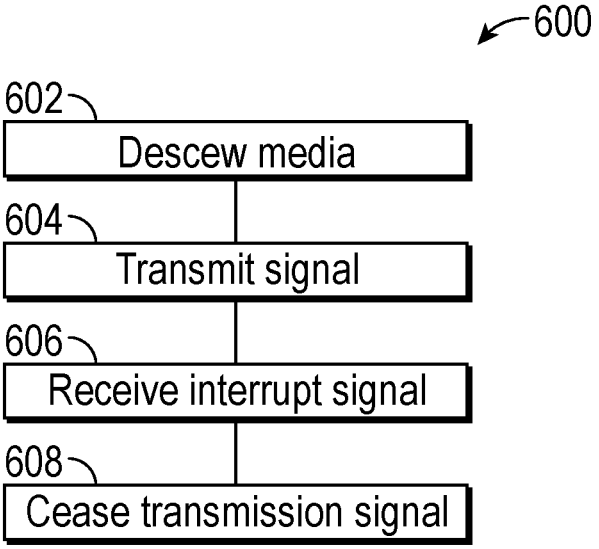
FIG. 6 shows an example method consistent with this disclosure.

In FIG. 5B, media object 502 is transported into media receiver 204. When more than one media object is received, media receiver 204 may deskew the plurality of media objects (602). For example, if a customer presents two or more bank notes into shutter 118, media receiver 204 may deskew the bank notes before presenting the bank notes to recycler 112.

Figure 5C:
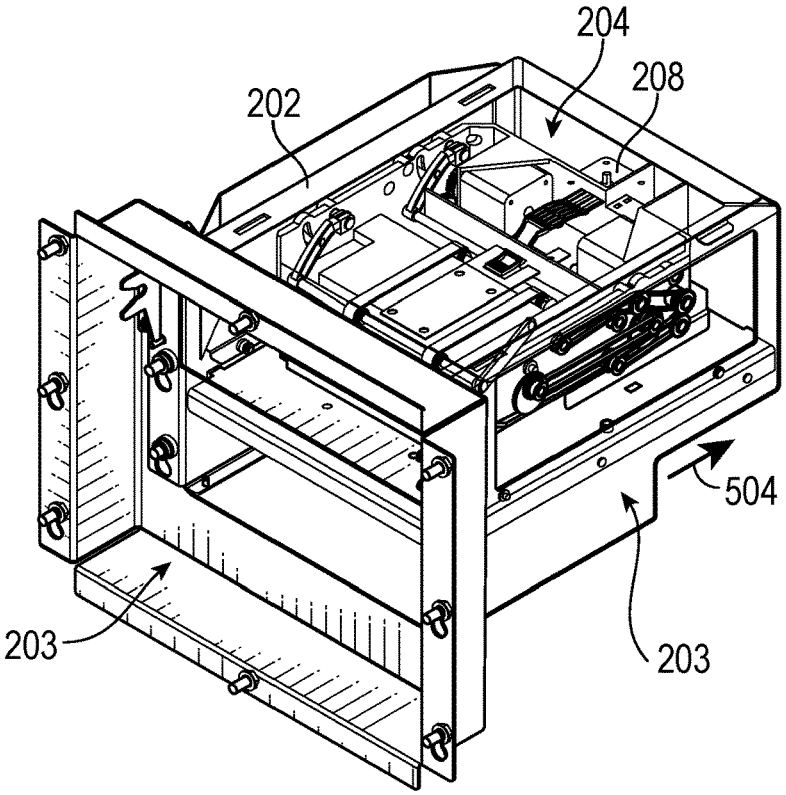

In FIG. 5C, media receiver 204 may translate as indicated by arrow 504. For example, controller 122 may transmit a signal, such as a translation signal, to translation motor 208 (604). The translation of media receiver 204 may allow media receiver 204 to be repositioned to a central location within housing 202. Stated another way, media receiver 204 may be repositioned via translation to a location within housing 202 so that media receiver 204 can rotate without hitting housing 202.

The translation of media receiver 204 may be limited by limit switch 304. For example, upon retracting media receiver 204 from opening 203, controller 122 may receive an interruption signal (604) from limit switch 304. In addition to limit switches, translation motor 208 may be a stepper motor and controller 122 may transmit pulses and/or count a number of steps translation motor 208 makes to reposition media receiver 204. Limit switch 304 may act as a safety to prevent media receiver 204 from over traveling. For example, if translation motor 208 is a stepper motor and misses a step or each step is not exactly even, then limit switch 304 may transmit the interruption signal to prevent overtravel of media receiver 204.

Figure 5D:
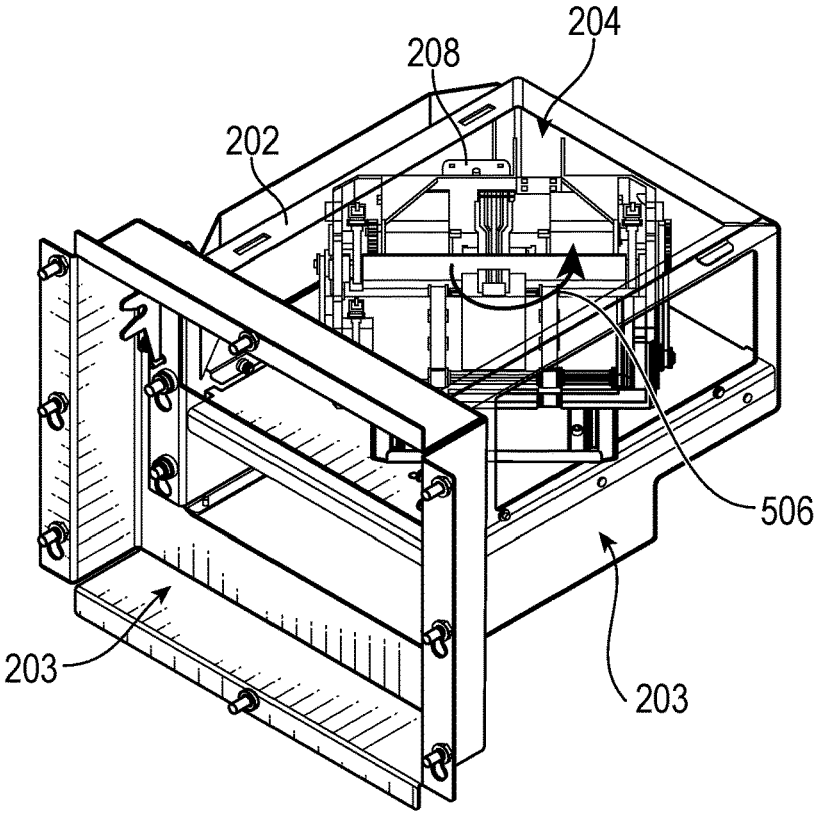
Figure 5E:
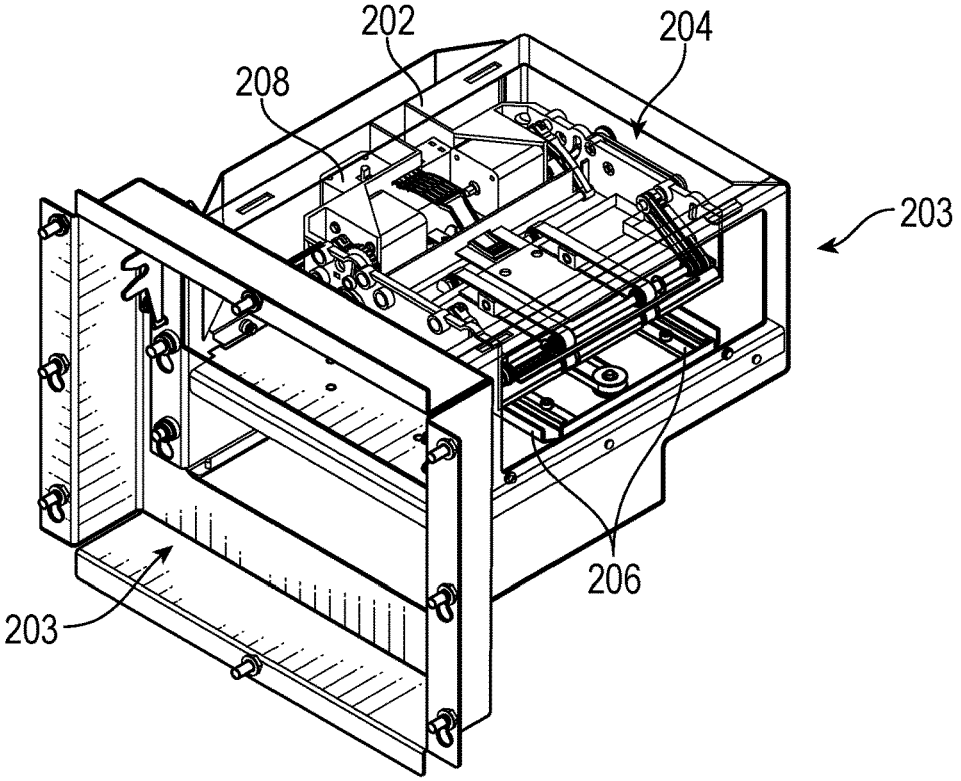

As shown in FIGS. 5D and 5E, media receiver 204 may rotate as indicated by arrow 506. For example, controller 122 may transmit a signal, such as a rotation signal, to rotation motor 302 (604). The rotation of media receiver 204 may allow media receiver 204 to be repositioned so that jaws of media receiver 204 face either shutter 118 or a recycler opening of recycler 112. Stated another way, media receiver 204 may be rotated 90° so that media receiver 204 can deliver media 502 to recycler 112 or the customer via shutter 118.

The rotation of media receiver 204 may be limited by limit switch 318. For example, upon rotating media receiver 204 90° or to a predetermined position/orientation, controller 122 may receive an interruption signal (604) from limit switch 318. In addition to limit switches, rotation motor 302 may be a stepper motor and controller 122 may transmit pulses and/or count a number of steps rotation motor 302 makes to rotate media receiver 204. Limit switch 318 may act as a safety to prevent media receiver 204 from over rotating. For example, if rotation motor 302 is a stepper motor and misses a step or each step is not exactly even, then limit switch 318 may transmit the interruption signal to prevent over rotation of media receiver 204.

Figure 5F:
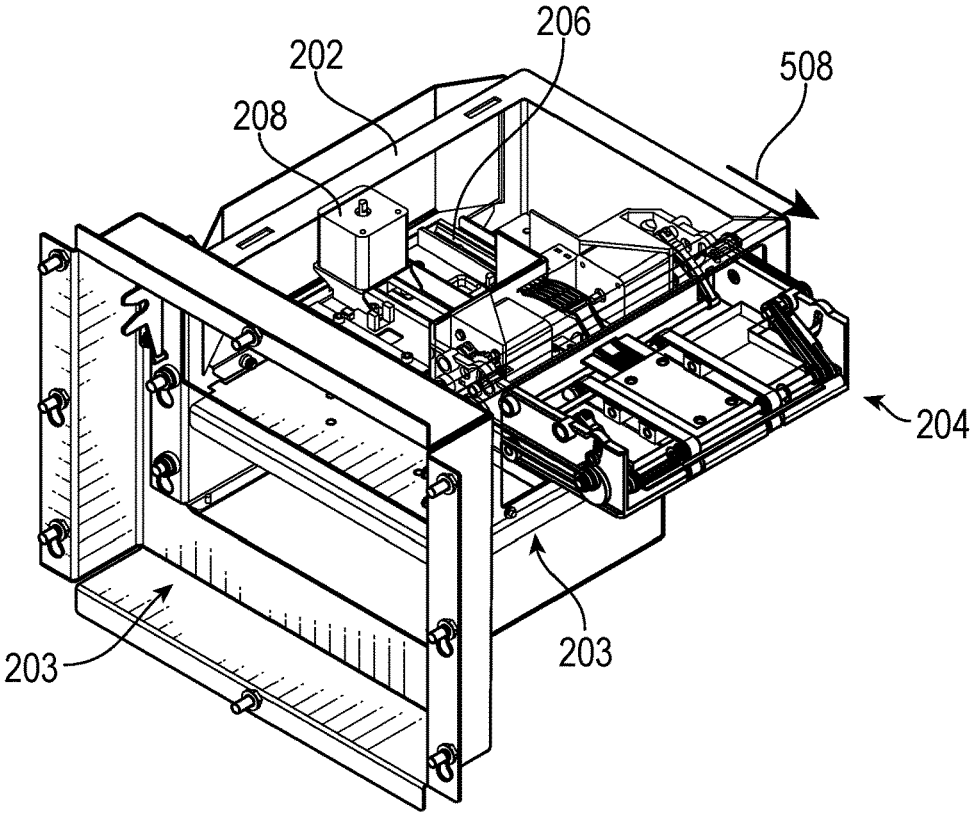
Figure 5G:
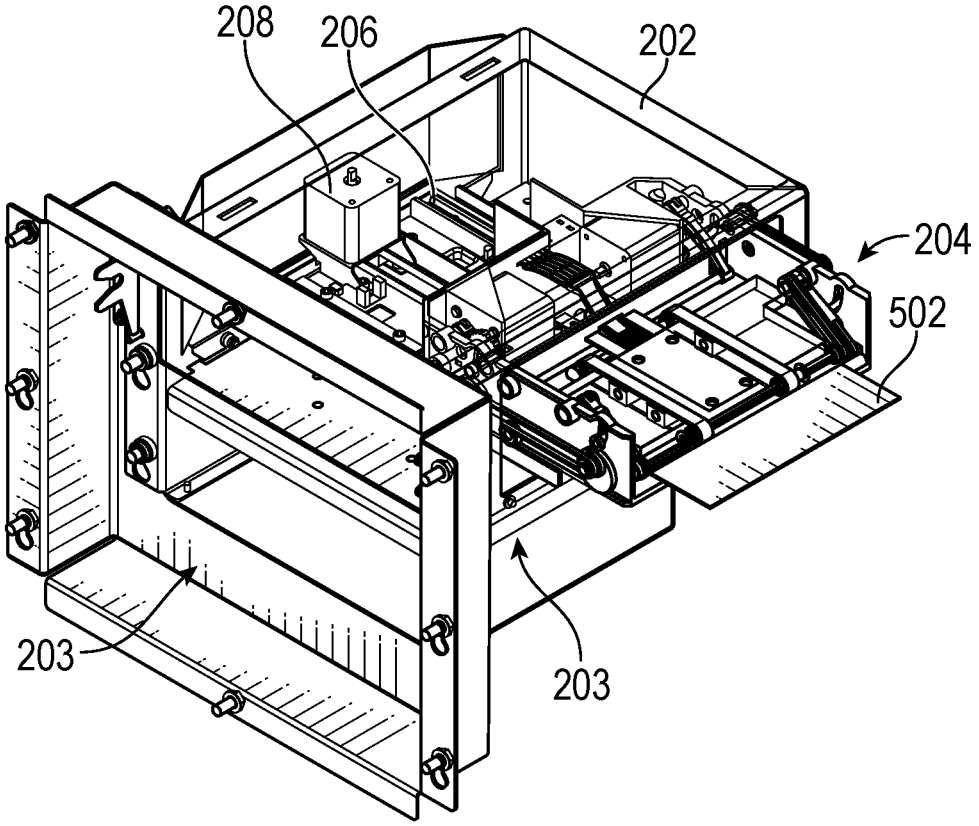

Upon rotating 90°, media receiver 204 may be translated as indicated by arrow 508 in FIG. 5F. For example, controller 122 may transmit a signal, such as a translation signal, to translation motor 208 (604). The translation of media receiver 204 may allow media receiver 204 to be repositioned from the central location within housing 202 toward shutter 118 and/or recycler 112. As disclosed herein, the translation of media receiver 204 may be limited by limit switches and/or controlled by controller 122 transmitting pulses or counting steps. Once media receiver 204 has rotated, media object 502 may be presented to the customer via shutter 118 and/or recycler 112 for deposit into safe 108.

EXAMPLES

Example 1 is a media rotation mechanism comprising: a housing defining a first opening and a second opening; a media receiver defining a media receiver opening; and a rotation motor operative to rotate the media receiver between a first position and a second position, the first position corresponding to the media receiver opening facing the first opening, the second position corresponding to the media receiver opening facing the second opening.

In Example 2, the subject matter of Example 1 optionally includes a limit switch in electrical communication with the rotation motor, the limit switch arranged to limit rotation of the media receiver in a first direction or a second direction.

In Example 3, the subject matter of any one or more of Examples 1-2 optionally include a track mechanically coupled to the media receiver; and a translation motor operative to translate the media receiver from a third position to a fourth position along the track.

In Example 4, the subject matter of Example 3 optionally includes a limit switch in electrical communication with the translation motor, the limit switch arranged to limit translation of the media receiver between the third position and the fourth position.

In Example 5, the subject matter of any one or more of Examples 3-4 optionally include wherein the translation motor is a stepper motor.

In Example 6, the subject matter of any one or more of Examples 1-5 optionally include wherein the rotation motor is a stepper motor.

In Example 7, the subject matter of any one or more of Examples 1-6 optionally include a turntable mechanically coupled to the rotation motor and the media receiver.

Example 8 is a media rotation mechanism for use in a media terminal, the media rotation mechanism comprising: a processor; and a memory storing instructions that, when executed by the processor, cause the processor to perform actions comprising: transmitting a rotation signal to a rotation motor, the rotation signal operative to activate the rotation motor, and cease transmitting the rotation signal.

In Example 9, the subject matter of Example 8 optionally includes a limit switch, and wherein the actions further comprise receiving an interruption signal from the limit switch, and wherein ceasing transmitting the rotation signal is in response to receiving the interruption signal.

In Example 10, the subject matter of any one or more of Examples 8-9 optionally include wherein the actions further comprise deskewing a plurality of media objects.

Example 11 is a media terminal comprising: a media recycler defining a media recycler opening; a shutter located adjacent the media recycler and arranged at an angle to the media recycler opening; and a media rotation mechanism located adjacent to the media recycler opening and the shutter, the media rotation mechanism comprising: a media receiver defining a media receiver opening, and a rotation motor operative to rotate the media receiver between a first position and a second position, the first position corresponding to the media receiver opening facing the shutter, the second position corresponding to the media receiver opening facing the media recycler opening.

In Example 12, the subject matter of Example 11 optionally includes a limit switch in electrical communication with the rotation motor, the limit switch arranged to limit rotation of the media receiver in a first direction or a second direction.

In Example 13, the subject matter of any one or more of Examples 11-12 optionally include a track mechanically coupled to the media receiver; and a translation motor operative to translate the media receiver from a third position to a fourth position along the track.

In Example 14, the subject matter of Example 13 optionally includes a limit switch in electrical communication with the translation motor, the limit switch arranged to limit translation of the media receiver between the third position and the fourth position.

In Example 15, the subject matter of any one or more of Examples 13-14 optionally include wherein the translation motor is a stepper motor.

In Example 16, the subject matter of any one or more of Examples 11-15 optionally include wherein the rotation motor is a stepper motor.

In Example 17, the subject matter of any one or more of Examples 11-16 optionally include a turntable mechanically coupled to the rotation motor and the media receiver.

In Example 18, the subject matter of any one or more of Examples 11-17 optionally include a processor in electrical communication with the rotation motor; and a memory storing instructions that, when executed by the processor, cause the processor to perform actions comprising transmitting a rotation signal to the rotation motor, the rotation signal operative to activate the rotation motor.

In Example 19, the subject matter of any one or more of Examples 11-18 optionally include a limit switch; a processor in electrical communication with the rotation motor and the limit switch; and a memory storing instructions that, when executed by the processor, cause the processor to perform actions comprising: transmitting a rotation signal to the rotation motor, the rotation signal operative to activate the rotation motor, receiving an interruption signal from the limit switch, and cease transmitting the rotation signal in response to receiving the interruption signal.

In Example 20, the subject matter of any one or more of Examples 18-19 optionally include wherein the actions further comprise deskewing a plurality of media objects.

In Example 21, the media rotation mechanisms, media terminals, and methods of any one of or any combination of Examples 1-20 are optionally configured such that all elements or options recited are available to use or select from.

The above detailed description refers to the accompanying drawings. Wherever possible, the same reference numbers are used in the drawings and the description to refer to the same or similar elements. While embodiments and examples are described, modifications, adaptations, and other implementations are possible. For example, substitutions, additions, and/or modifications may be made to the elements and stages illustrated in the drawings, and the systems and methods described herein may be modified by substituting, reordering, and/or adding stages to the disclosed methods and/or elements to the discloses systems. Accordingly, the detailed description does not limit this disclosure. Instead, the proper scope of any invention disclosed herein is defined by the appended claims.

It will be readily understood to those skilled in the art that various other changes in the details, material, and arrangements of the parts and method stages which have been described and illustrated in order to explain the nature of the subject matter may be made without departing from the principles and scope of the inventive subject matter as expressed in the subjoined claims.

The invention claimed is:

1. A media rotation mechanism comprising:

a housing defining a first opening and a second opening located at an angle relative to the first opening;

a media receiver defining a media receiver opening, the media receiver, the first opening, and the second opening defining a non-linear travel path for a media object through the angle;

a rotation motor operative to rotate the media receiver through the angle about a single axis between a first position and a second position, the first position corresponding to the media receiver opening facing the first opening, the second position corresponding to the media receiver opening facing the second opening; and a turntable mechanically coupled to the rotation motor and the media receiver.

2. The media rotation mechanism of claim 1, further comprising a limit switch in electrical communication with the rotation motor, the limit switch arranged to limit rotation of the media receiver in a first direction or a second direction.

3. The media rotation mechanism of claim 1, further comprising:

a track mechanically coupled to the media receiver; and a translation motor operative to translate the media receiver from a third position to a fourth position along the track.

4. The media rotation mechanism of claim 3, further comprising a limit switch in electrical communication with the translation motor, the limit switch arranged to limit translation of the media receiver between the third position and the fourth position.

5. The media rotation mechanism of claim 3, wherein the translation motor is a stepper motor.

6. The media rotation mechanism of claim 1, wherein the rotation motor is a stepper motor.

7. A media rotation mechanism for use in a media terminal, the media rotation mechanism comprising:

a processor; and a memory storing instructions that, when executed by the processor, cause the processor to perform actions comprising:

transmitting a rotation signal to a rotation motor, the rotation signal operative to activate the rotation motor, and cease transmitting the rotation signal upon a media receiver rotating 90 degrees about a single vertical axis, wherein during activation of the rotation motor, a media object rotates within a single plane.

8. The media rotation mechanism of claim 7, further comprising:

a limit switch, and wherein the actions further comprise receiving an interruption signal from the limit switch, and wherein ceasing transmitting the rotation signal is in response to receiving the interruption signal.

9. The media rotation mechanism of claim 7, wherein the actions further comprise deskewing a plurality of media objects.

10. A media terminal comprising:

a media recycler defining a media recycler opening;

a shutter located adjacent the media recycler and arranged at an angle to the media recycler opening; and a media rotation mechanism located adjacent to the media recycler opening and the shutter, the media rotation mechanism comprising:

a media receiver defining a media receiver opening, a rotation motor operative to rotate the media receiver about a single axis between a first position and a second position, the first position corresponding to the media receiver opening facing the shutter, the second position corresponding to the media receiver opening facing the media recycler opening, and a turntable mechanically coupled to the rotation motor and the media receiver.

11. The media terminal of claim 10, further comprising a limit switch in electrical communication with the rotation motor, the limit switch arranged to limit rotation of the media receiver in a first direction or a second direction.

12. The media terminal of claim 10, further comprising:

a track mechanically coupled to the media receiver; and a translation motor operative to translate the media receiver from a third position to a fourth position along the track.

13. The media terminal of claim 12, further comprising a limit switch in electrical communication with the translation motor, the limit switch arranged to limit translation of the media receiver between the third position and the fourth position.

14. The media terminal of claim 12, wherein the translation motor is a stepper motor.

15. The media terminal of claim 10, wherein the rotation motor is a stepper motor.

16. The media terminal of claim 10, further comprising:

a processor in electrical communication with the rotation motor; and a memory storing instructions that, when executed by the processor, cause the processor to perform actions comprising transmitting a rotation signal to the rotation motor, the rotation signal operative to activate the rotation motor.

17. The media terminal of claim 10, further comprising:

a limit switch;

a processor in electrical communication with the rotation motor and the limit switch; and a memory storing instructions that, when executed by the processor, cause the processor to perform actions comprising:

transmitting a rotation signal to the rotation motor, the rotation signal operative to activate the rotation motor, receiving an interruption signal from the limit switch, and cease transmitting the rotation signal in response to receiving the interruption signal.

18. The media terminal of claim 16, wherein the actions further comprise deskewing a plurality of media objects.

* * * * *